US006530816B1

(12) United States Patent
Chiu

(10) Patent No.: US 6,530,816 B1
(45) Date of Patent: Mar. 11, 2003

(54) PINWHEEL WITH A GENERATOR

(75) Inventor: Chun-Chen Chiu, Taichung Hsien (TW)

(73) Assignee: O Bat Technology Ltd., Taichung Hsien (TW)

( * ) Notice: Subject to any disclaimer, the term of this patent is extended or adjusted under 35 U.S.C. 154(b) by 0 days.

(21) Appl. No.: 10/218,441

(22) Filed: Aug. 15, 2002

(51) Int. Cl.[7] ..... A63H 33/40
(52) U.S. Cl. ..... 446/217; 445/218; 445/484
(58) Field of Search ..... 446/217, 176, 446/218, 175, 484

(56) References Cited

U.S. PATENT DOCUMENTS 2,857,507 A * 10/1958 Stec ..... 40/432
3,974,369 A * 8/1976 Chmela et al. ..... 362/190
4,120,561 A * 10/1978 Burkholder ..... 359/525

* cited by examiner

*Primary Examiner*—Jacob K. Ackun
*Assistant Examiner*—Bena B. Miller
(74) *Attorney, Agent, or Firm*—Bacon & Thomas

(57) ABSTRACT

A pinwheel has a body, multiple lighting devices, a securing base, a securing cap and a generator. Multiple blades extend outward from the body and each has a lighting device mounted on the blade. The securing base and the securing cap are securely attached to the body to receive the generator. The generator has an annular coil seat and an annular permanent magnet. The coil seat is securely mounted between the securing base and the securing cap and electrically connected to two electrodes of the lighting devices. The annular permanent magnet is rotatably mounted between the securing base and the securing cap and in a center of the coil seat. Accordingly, the electrical power will be generated when the body rotates and the lighting devices will light. The appearance of the pinwheel is versatile.

17 Claims, 7 Drawing Sheets

PINWHEEL WITH A GENERATOR

BACKGROUND OF THE INVENTION

1. Field of the Invention

The present invention relates to a pinwheel, and more particularly to a pinwheel with a generator.

2. Description of Related Art

A pinwheel is a popular toy for children and substantially comprises a body with multiple blades rotatably mounted on a rod. However, the conventional pinwheel cannot provide sound or light, and the visual effect of the pinwheel is just only provided by the appearance of the pinwheel itself. The visual appearance of the pinwheel is not versatile, and the fun of playing the pinwheel is limited.

To overcome the shortcomings, the present invention tends to provide a pinwheel with a generator to mitigate or obviate the aforementioned problems.

SUMMARY OF THE INVENTION

The main objective of the invention is to provide a pinwheel with a generator to generate electricity when the pinwheel rotates so as to improve the decorative appearance of the pinwheel. The pinwheel has a body, multiple lighting devices, a securing base, a securing cap and a generator. Multiple blades extend outward from the body and each has a lighting device mounted on the blade. The securing base and the securing cap are securely attached to the body to receive the generator. The generator has an annular coil seat and an annular permanent magnet. The annular coil seat is securely mounted between the securing base and the securing cap. A winding is wound around the coil seat and has two ends respectively connected to two electrodes of the lighting devices. The annular permanent magnet is rotatably mounted between the securing base and the securing cap and in a center of the coil seat. A gap is defined between the outer periphery of the permanent magnet and the inner periphery of the coil seat. Accordingly, the electrical power will be generated when the body rotates and the lighting devices will light. The fun of playing the pinwheel is improved in relation to the prior art.

Other objects, advantages and novel features of the invention will become more apparent from the following detailed description when taken in conjunction with the accompanying drawings.

DETAILED DESCRIPTION OF PREFERRED EMBODIMENT

Figure 1:
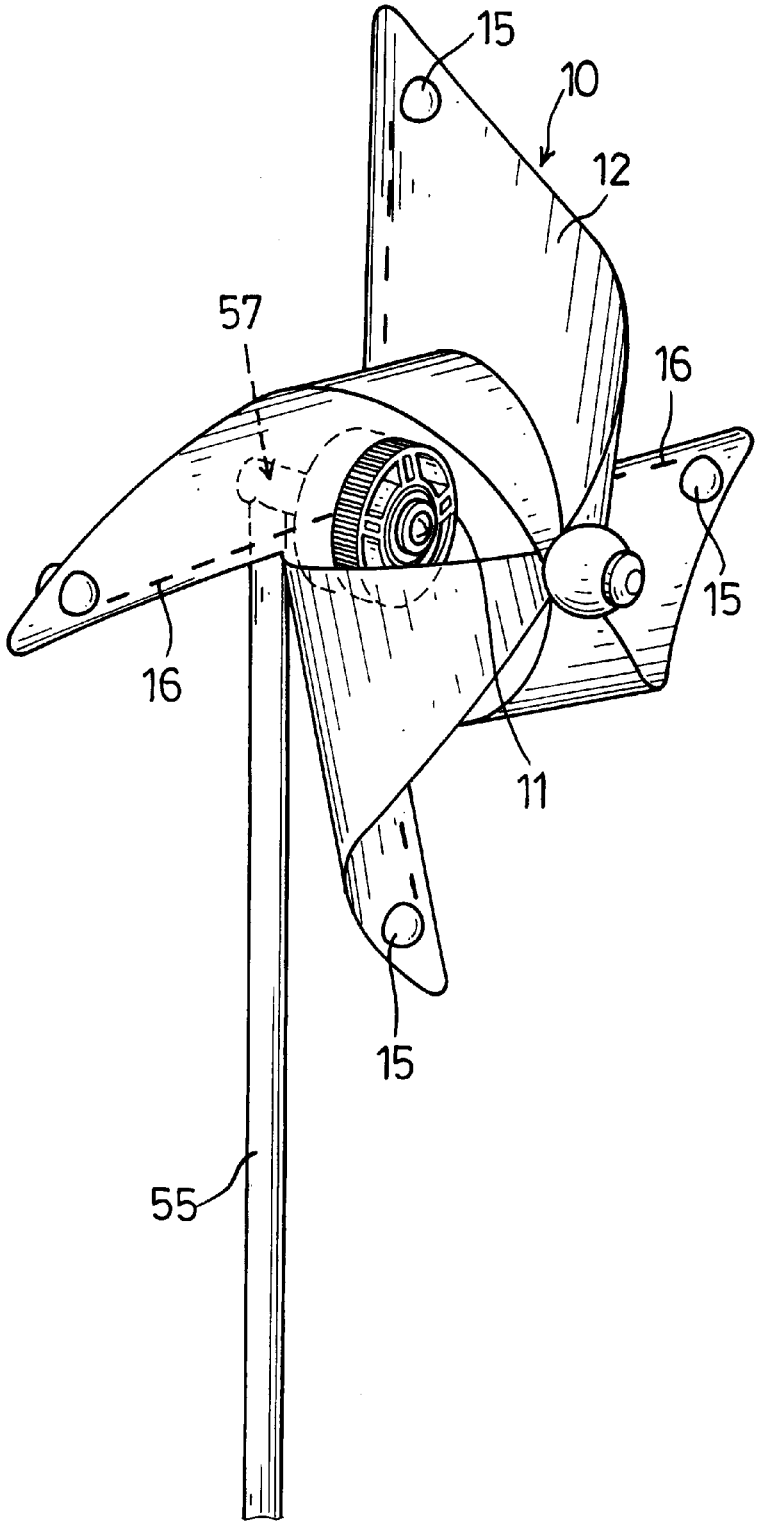
FIG. 1 is a front perspective view of a pinwheel with a generator in accordance with the present invention.
Figure 2:
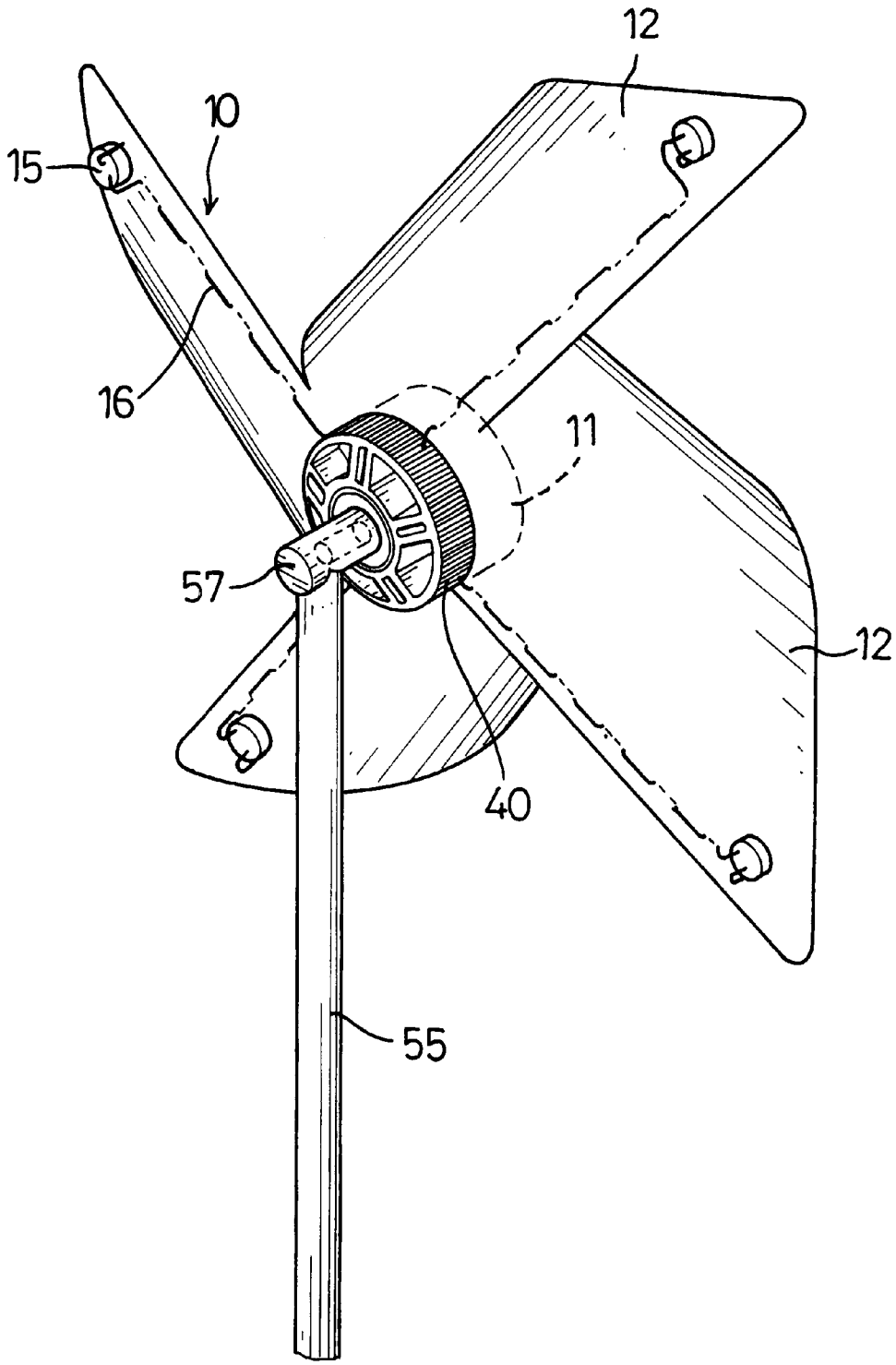
FIG. 2 is a rear perspective view of the pinwheel in FIG. 1.

With reference to FIGS. 1 to 4, a pinwheel in accordance with the present invention comprises a body (10), multiple lighting devices (15), a securing base (11), a securing cap (40) and a generator. The body (10) has multiple blades (12) extending outward from the body (10). At least one of the lighting devices (15) is mounted on each respective blade (12). The securing base (11) is securely attached to one side of the body (10). A recess (113) is defined in the securing base (11), and a hole (111) is defined in the securing base (11) at the face defining the recess (113).

The securing cap (40) is securely attached to the other side of the body (10). A recess (41) is defined in the securing cap (40) and corresponds to the recess (113) in the securing base (11). A hole (43) is defined in the securing cap (40) at the face defining the recess (41). The securing base (11) has at least one stub (13) extending outward from the securing base (11) and through the body (10). The securing cap (40) has an aperture (451) corresponding to each respective stub (13) on the securing base (11) to securely receive the corresponding stub (13). The securing cap (40) has at least one stub (45) extending outward from the securing cap (40). The securing base (11) has an aperture (131) corresponding to each respective stub (45) on the securing cap (40) to securely receive the corresponding stub (45). Consequently, the securing cap (40) is securely attached to the securing base (11) by means of the engagements between the stubs (13,45) and apertures (131,451) so as to sandwich the body (10) between the securing base (11) and the securing cap (40).

The generator is received between recesses (113,41) in the securing base (11) and the securing cap (40), and is electrically connected to the lighting devices (15) to provide electric power to the lighting devices (15) while the body (10) rotates. The generator comprises an annular coil seat (20) and an annular permanent magnet (35). The annular coil seat (20) is securely received in the recesses (113) of the securing base (11) and the securing cap (40). The annular coil seat (20) has a winding (not numbered) wound around the coil seat. The winding has two ends respectively connected to two electrodes (151,152) of the lighting devices (15). A metal cover(201,202) is securely attached to each respective side of the coil seat (20) and is connected with one end of the winding. Multiple teeth (21) extend perpendicularly from an inner periphery of each cover (201,202) and abut the inner periphery of the coil seat (20), such that each cover (201,202) will securely attach to one side of the coil seat (20). In practice, with reference to FIGS. 3 to 5, the body (10) with the blades (12) is made of a conductive material. The first electrode (151) of each respective lighting device (15) is connected to one of the metal covers (202) with a connecting wire (16) with a nonconductive coating. The second electrode (152) of each respective lighting device (15) is attached to corresponding one of the blades (12). One connecting wire (23) is connected between one end of the winding and the body (10), such that the second electrodes (152) of the light devices (15) are electrically connected to the end of the winding through the body (10) and the connecting wire (23).

In another embodiment, two electrodes (151,152) of each respective lighting device (15) are respectively connected to two ends of the winding with two connecting wires.

Figure 6:
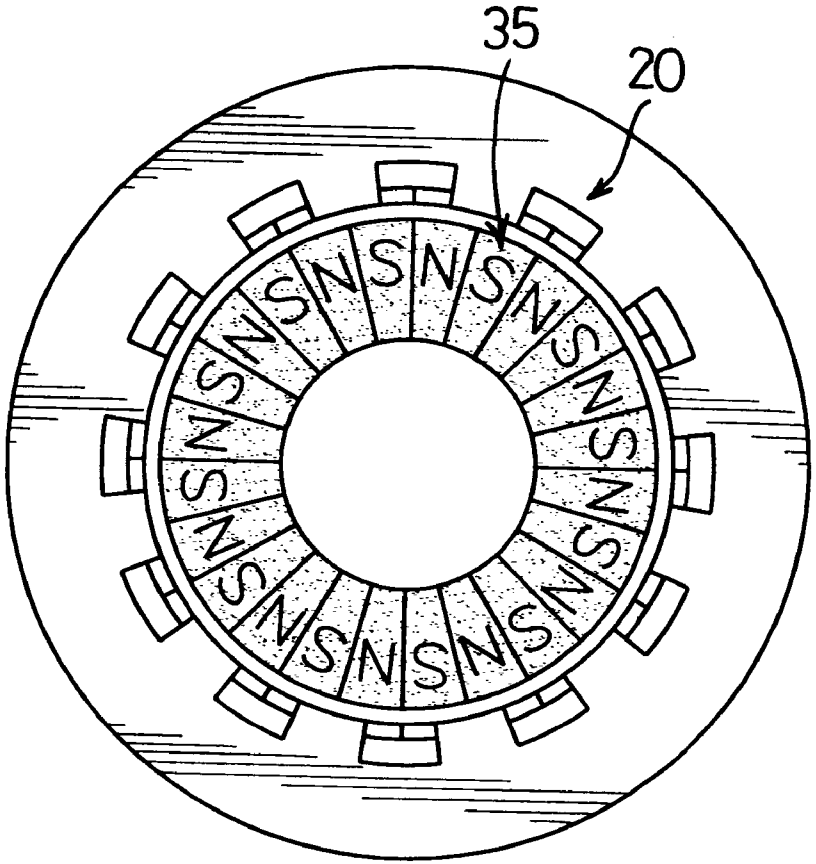
FIG. 6 is a side plan view of the generator in FIG. 1 showing the magnetism arrangement of the permanent magnet.

The annular permanent magnet (35) is rotatably mounted between the securing base (11) and the securing cap (40) and in a center of the coil seat (20). A gap is defined between the outer periphery of the permanent magnet (35) and the inner periphery of the coil seat (20). The magnetic poles of the permanent magnet (35) are alternately arranged around the permanent magnet (35) as shown in FIG. 6. The generator further comprises a nonconductive sleeve (30) for the permanent magnet (35) being pressed onto the nonconductive sleeve (30). Two bearings (14,44) are respectively received in the holes (111,43) of the securing base (11) and the securing cap (40). The nonconductive sleeve (30) is mounted between the bearings (14,44) and has two ends respectively extending into one of the bearings (14,44). Consequently, the permanent magnet (35) is rotatably mounted between the securing base (11) and the securing cap (40).

In addition, an axle (50) extends through the securing base (11) and the sleeve (30). An outer thread (not numbered) is formed on the axle at the end extending through the sleeve (30). A rod (55) is secured to the axle (50) at an end extending through the sleeve (30). The rod (55) has a connecting portion (57) with an inner thread laterally extending on the top of the rod (55) to screw with the outer thread on the axle (50). Accordingly, the body (10) is rotatably mounted on the rod (55). When the air blows on the blades (12), the body (10) with the blades (12) will be actuated to rotate relative to the rod (55).

Figure 3:
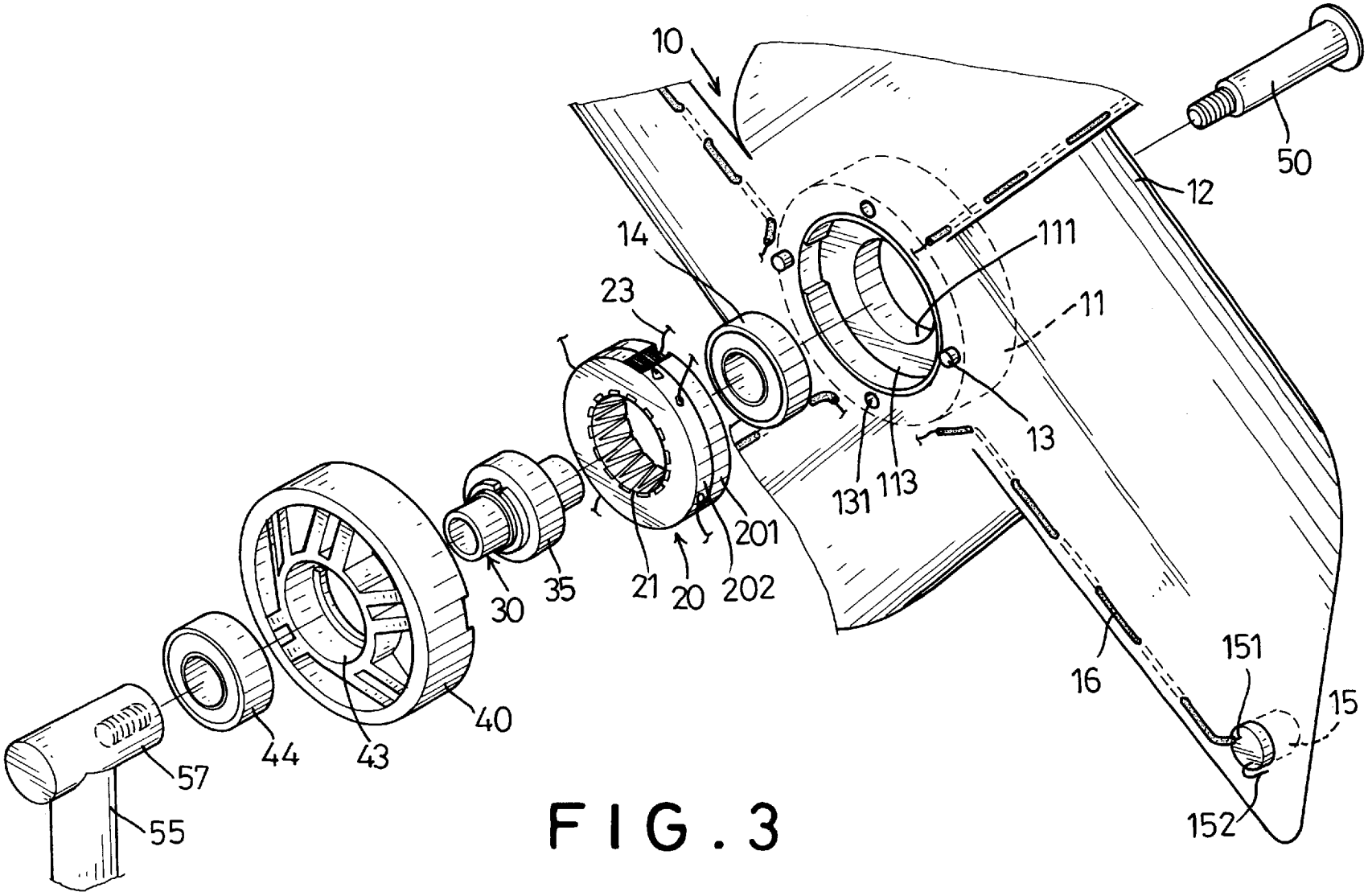
FIG. 3 is an exploded perspective view of pinwheel in FIG. 1.
Figure 4:
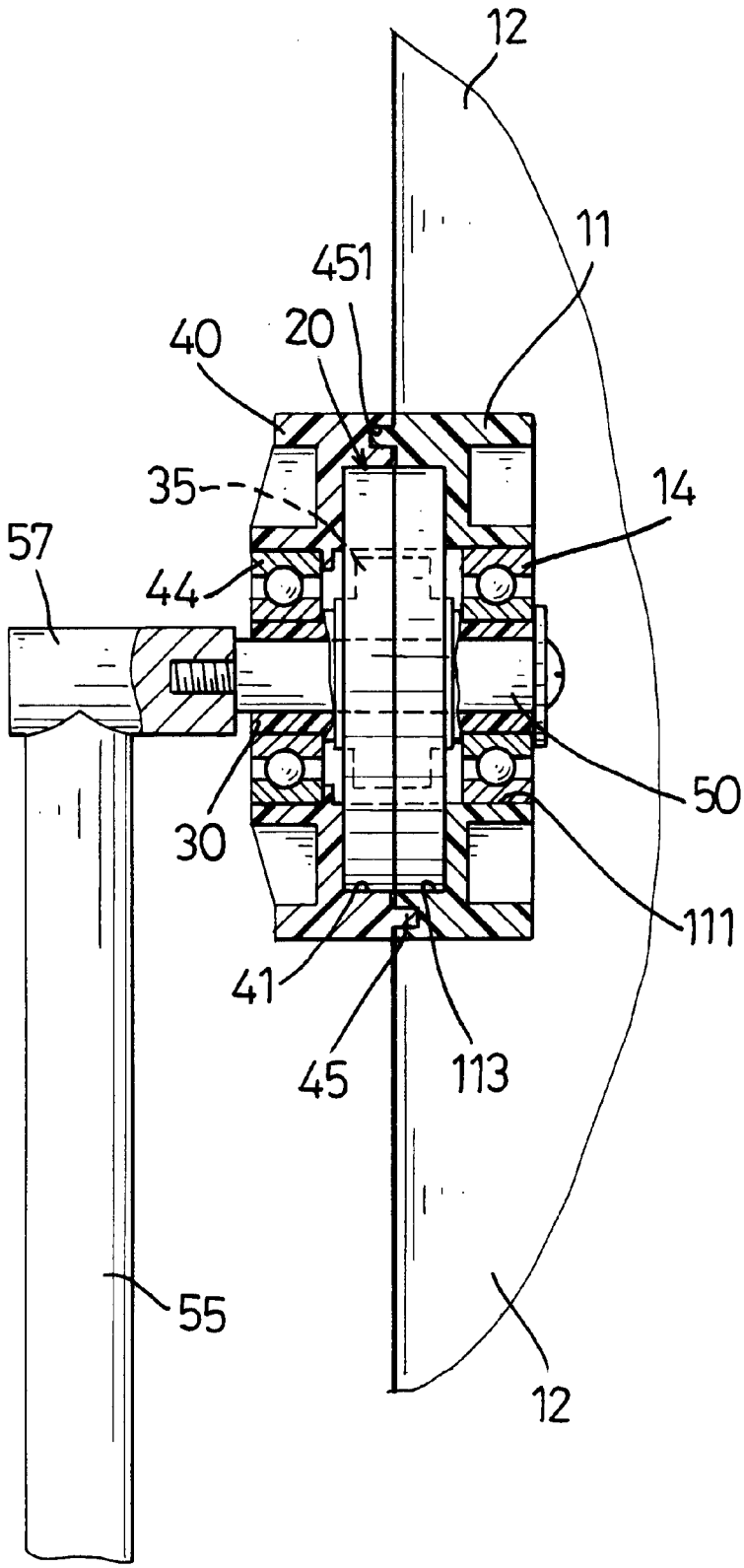
FIG. 4 is a side plan view in partial cross section of the pinwheel in FIG. 1.
Figure 5:
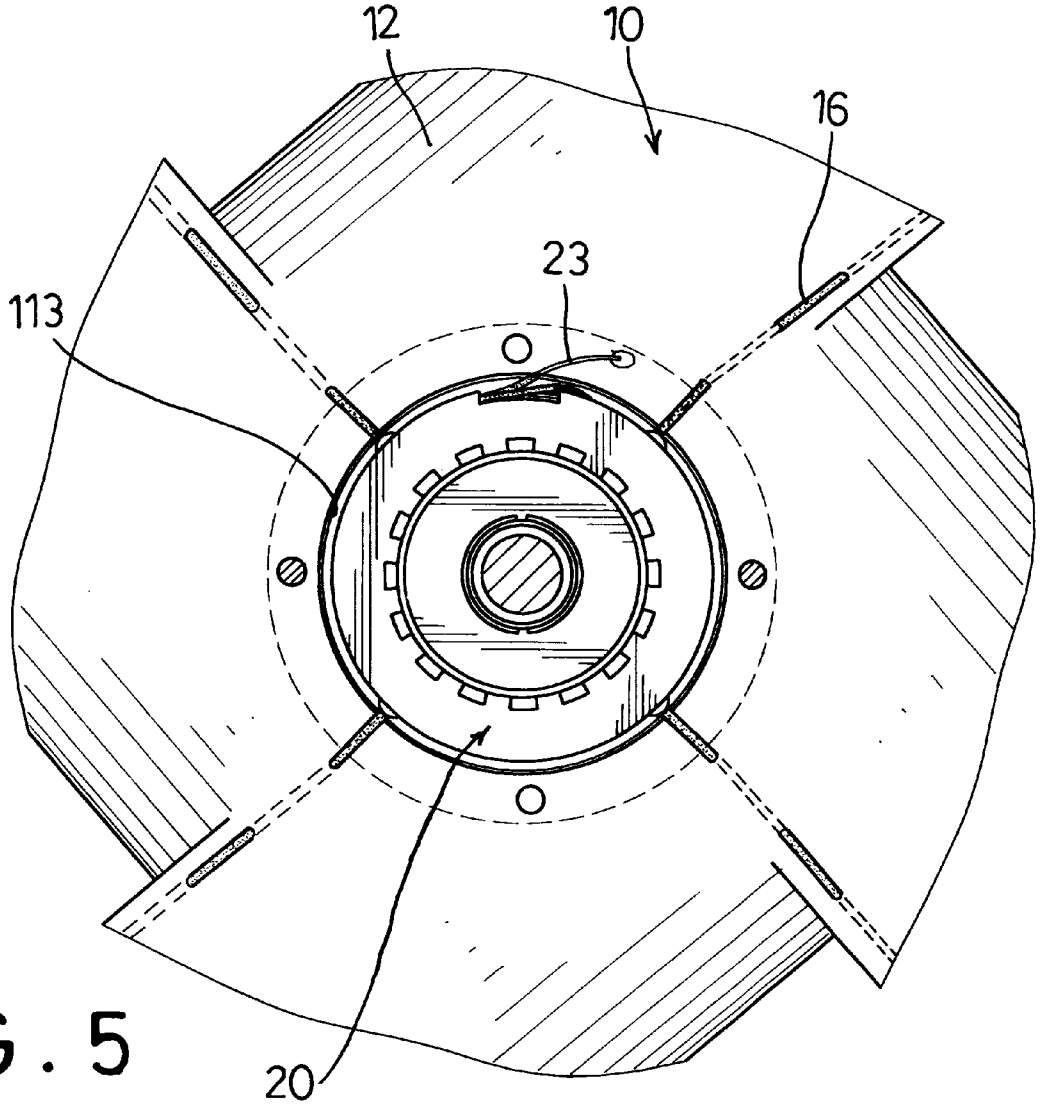
FIG. 5 is a partially enlarged front plan view of the pinwheel in FIG. 1.
Figure 7:
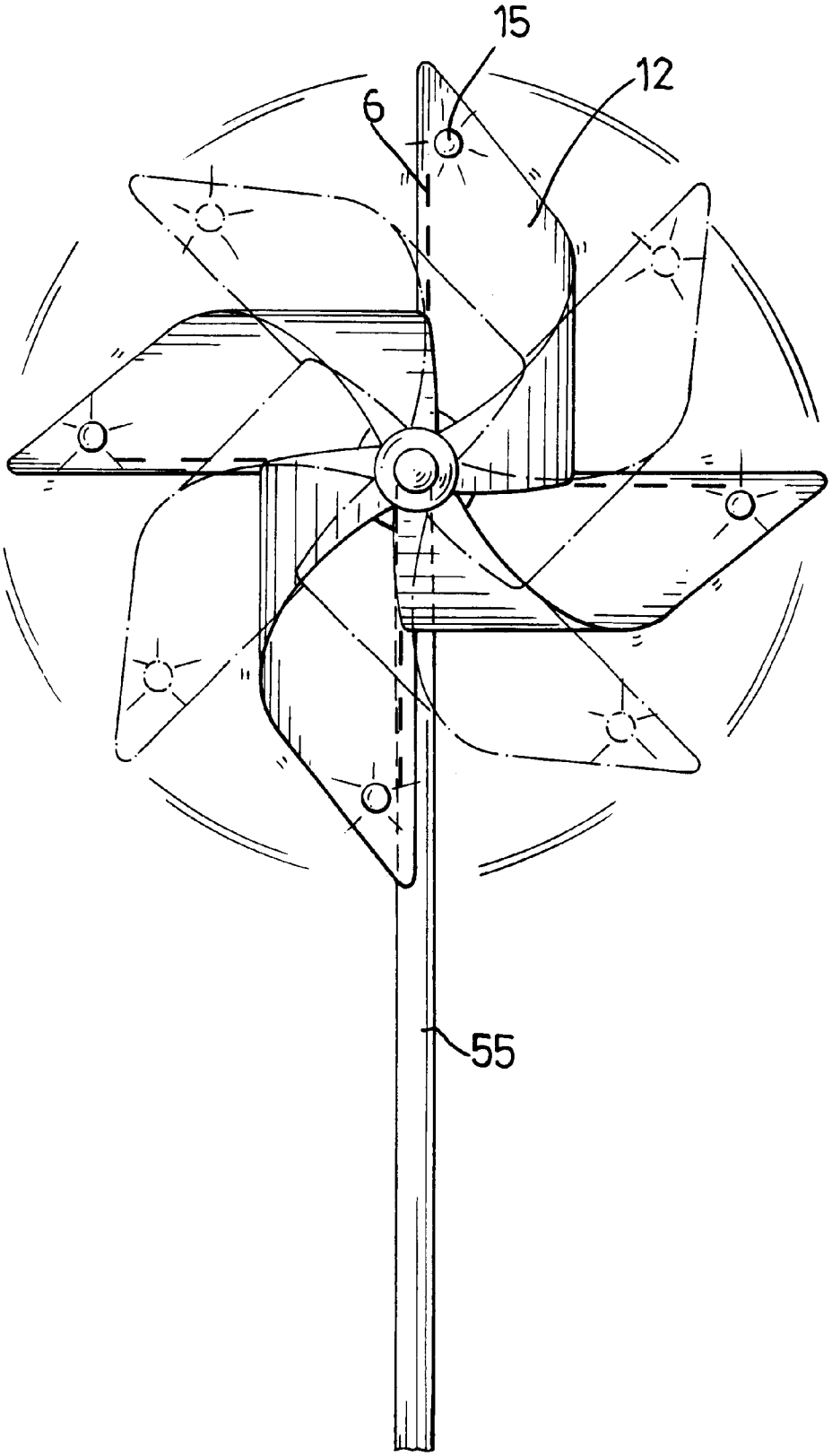
FIG. 7 is an operational front plan view of the pinwheel in FIG. 1.

With reference to FIGS. 3, 4 and 7, when the body (10) rotates, the coil seat (20) will rotate with the body (10) and relative to the magnet (35). The winding wound in the coil seat (20) will cut through the magnetic line of flux of the permanent magnet (35) and generate electricity. The electricity will be transmitted to the lighting devices (15) through the covers (202), the connecting wires (16,23), the body (10) and the blades (12), and the lighting devices (15) will illuminate. Consequently, the enjoyment of using the pinwheel is improved. In addition, the lighting device (15) can be replaced by a sounding device, such that the sound caused by the sounding devices has a similar novel appeal as the lighting devices. Furthermore, the lighting devices (15) or the sounding devices can provide a warning effect to other people at night and the safety of using the pinwheel is also improved.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A pinwheel comprising:

a body with multiple blades extending outward from the body;

a securing base securely attached to the body;

a lighting device mounted on each respective blade;

a securing cap securely connected to the securing base; and a generator received between the securing base and the securing cap and electrically connected to the lighting devices to provide electric power to the lighting devices while the body rotates, the generator composed of:

an annular coil seat securely mounted between the securing base and the securing cap and having a winding wound around the coil seat, the winding having two ends respectively connected to two electrodes of the lighting devices;

an annular permanent magnet rotatably mounted between the securing base and the securing cap and in a center of the coil seat; and a gap defined between an outer periphery of the permanent magnet and an inner periphery of the coil seat.

2. The pinwheel as claimed in claim 1 further comprising two bearings respectively received in the securing base and the securing cap; and a nonconductive sleeve mounted between the bearings and having two ends respectively extending into one of the bearings, wherein the permanent magnet is pressed onto the nonconductive sleeve between the bearings.

3. The pinwheel as claimed in claim 2, wherein the securing base has a first recess defined in the securing base and a first hole defined in the securing base at a face defining the first recess to receive a first of the bearings;

the securing cap has a second recess defined in the securing cap to receive the coil seat in cooperation with the first recess in the securing base; and the securing cap has a second hole defined in a face defining the second recess to receive a second of the bearings.

4. The pinwheel as claimed in claim 3, wherein the securing base has at least one stub extending outward from the body; and the securing cap has an aperture corresponding to each respective at least one stub on the securing base to securely receive the corresponding stub.

5. The pinwheel as claimed in claim 3, wherein the securing cap has at least one stub extending outward from the securing cap; and the securing base has an aperture corresponding to each respective at least one stub on the securing cap to receive the corresponding stub.

6. The pinwheel as claimed in claim 1 further comprising an axle extending through the securing base and the sleeve; and a rod secured to the axle at an end extending through the sleeve.

7. The pinwheel as claimed in claim 6, wherein the axle has an outer thread formed on the axle at the end extending through the sleeve;

the rod has a connecting portion with an inner thread laterally extending on a top of the rod to screw with the outer thread on the axle.

8. The pinwheel as claimed in claim 1, wherein a metal cover is securely attached to each respective side of the coil seat and connected with one end of the winding.

9. The pinwheel as claimed in claim 8, wherein multiple teeth extend perpendicularly from an inner periphery of each of said metal cover and abut the inner periphery of the coil seat.

10. The pinwheel as claimed in claim 8, wherein the body with the blades is made of a conductive material;

a first electrode of each respective lighting device is connected to a first end of the winding with a first connecting wire with a nonconductive coating;

a second electrode of each respective lighting device is attached to corresponding one of the blades; and a second connecting wire is connected between a second end of the winding and the body so as to electrically connect the second end of the winding to the second electrodes of the lighting devices through the second connecting wire, the body and the blades.

11. The pinwheel as claimed in claim 1, wherein the body with the blades is made of a conductive material;

a first electrode of each respective lighting device is connected to a first end of the winding with a first connecting wire with a nonconductive coating;

a second electrode of each respective lighting device is attached to corresponding one of the blades;

a second connecting wire is connected between a second end of the winding and the body so as to electrically connect the second end of the winding to the second electrodes of the lighting devices through the second connecting wire, the body and the blades.

12. The pinwheel as claimed in claim 1, wherein two electrodes of each respective lighting device are respectively connected to two ends of the winding with two connecting wires.

13. The pinwheel as claimed in claim 1, wherein the securing base and the securing cap are respectively attached to two sides of the body.

14. The pinwheel as claimed in claim 13 further comprising two bearings respectively received in the securing base and the securing cap; and a nonconductive sleeve mounted between the bearings and having two ends respectively extending into one of the bearings, wherein the permanent magnet is pressed onto the nonconductive sleeve between the bearings.

15. The pinwheel as claimed in claim 14, wherein the securing base has a first recess defined in the securing base and a first hole defined in securing base at a face defining the first recess to receive a first of the bearings;

the securing cap has a second recess defined in the securing cap to receive the coil seat in cooperation with the first recess in the securing base; and the securing cap has a second hole defined in a face defining the second recess to receive a second of the bearings.

16. The pinwheel as claimed in claim 15, wherein the securing base has at least one stub extending outward from the body and through the body; and the securing cap has an aperture corresponding to each respective at least one stub on the securing base to securing receive the corresponding stub, thereby the body is sandwiched between the securing base and the securing cap.

17. The pinwheel as claimed in claim 15, wherein the securing cap has at least one stub extending outward from the securing cap; and the securing base has an aperture corresponding to each respective at least one stub on the securing cap to receive the corresponding stub, thereby the body is sandwiched between the securing base and the securing cap.

* * * * *